US010145366B2

(12) United States Patent
Andersen et al.

(10) Patent No.: US 10,145,366 B2
(45) Date of Patent: Dec. 4, 2018

(54) HYDRAULIC ARRANGEMENT

(71) Applicant: Danfoss A/S, Nordborg (DK)

(72) Inventors: Stig Kildegaard Andersen, Krusaa (DK); Erik Haugaard, Gråsten (DK); Palle Olsen, Nordborg (DK); Poul Erik Hansen, Aabenraa (DK)

(73) Assignee: Danfoss A/S, Nordborg (DK)

( * ) Notice: Subject to any disclaimer, the term of this patent is extended or adjusted under 35 U.S.C. 154(b) by 262 days.

(21) Appl. No.: 15/017,764

(22) Filed: Feb. 8, 2016

(65) Prior Publication Data

US 2016/0230761 A1 Aug. 11, 2016

(30) Foreign Application Priority Data

Feb. 11, 2015 (EP) ..... 15154612

(51) Int. Cl.

| | |
|---|---|
| ***F04B 1/18*** | (2006.01) |
| ***F04B 1/14*** | (2006.01) |
| ***F04B 53/16*** | (2006.01) |
| ***F04B 1/10*** | (2006.01) |
| ***F04B 1/20*** | (2006.01) |

(52) U.S. Cl.

CPC ..... *F04B 1/184* (2013.01); *F04B 1/10* (2013.01); *F04B 1/145* (2013.01); *F04B 1/20* (2013.01); *F04B 1/2014* (2013.01); *F04B 53/16* (2013.01)

(58) Field of Classification Search

CPC ..... B01D 2313/246; B01D 2313/243; B01D 61/025; B01D 61/06; B01D 61/10; F04D 13/12; F04F 13/00; F04B 1/2035; F04B 1/0452; F04B 1/0456; F04B 1/0465; F04B 1/184; F04B 1/186; F04B 1/188; F04B 1/2021; F04B 1/145; F04B 53/16; F04B 17/03

See application file for complete search history.

(56) References Cited

U.S. PATENT DOCUMENTS 2,316,429 A * 4/1943 Henderson ..... F04B 47/00 417/450
4,550,645 A * 11/1985 Beck, Jr. ..... F04B 1/2042 29/888.02

FOREIGN PATENT DOCUMENTS

| | | | | |
|---|---|---|---|---|
| CN | 102858436 | A | 1/2013 | |
| CN | 102138007 | B | 4/2014 | |
| DE | 10 2008 044 869 | A1 | 3/2010 | |
| DE | 10 2011 116 862 | A1 | 4/2013 | |
| DE | 10 2011 116 864 | A1 | 4/2013 | |
| DE | 10 2011 116 867 | A1 | 4/2013 | |
| DE | 10201116862 | * | 4/2013 | ..... F04D 13/12 |

* cited by examiner

*Primary Examiner* — Kenneth J Hansen

(74) *Attorney, Agent, or Firm* — McCormick, Paulding & Huber LLP

(57) ABSTRACT

A hydraulic arrangement (1) is provided comprising a pressure exchanger (2) having an axis (3) of rotation, and a booster pump (4), said pressure exchanger (2) and said booster pump (4) being connected to each other. Such a hydraulic arrangement should have a good efficiency. To this end a single connection flange (5) is provided between said pressure exchanger (2) and the booster pump (4).

18 Claims, 2 Drawing Sheets

HYDRAULIC ARRANGEMENT

CROSS REFERENCE TO RELATED APPLICATION

Applicant hereby claims foreign priority benefits under U.S.C. § 119 from European Patent Application No. EP15154612.4 filed on Feb. 11, 2015, the content of which is incorporated by reference herein.

TECHNICAL FIELD

The present invention relates to a hydraulic arrangement comprising a pressure exchanger having an axis of rotation, and a booster pump, said pressure exchanger and said booster pump being connected to each other.

BACKGROUND

Such a hydraulic arrangement can be used, for example, in a reverse osmosis system. In such a reverse osmosis system polluted or salted water is pumped under high pressure through a membrane. Part of the water penetrates the membrane and can be gained as purified water. The remaining part of the water which is still under a relatively high pressure, has to be wasted. However, in order not to lose too much energy, the pressure of this part of the water should be recovered. To this end a pressure exchanger is used transferring the pressure of the wasted water at least partially to fresh water. Since some pressure losses are unavoidable, a booster pump is used to bring the fresh water to the pressure level needed for reverse osmosis.

SUMMARY

The object underlying the present invention is to have such a hydraulic arrangement with a good efficiency.

This object is solved with a hydraulic arrangement as described at the outset in that a single connection flange is provided between said pressure exchanger and said booster pump.

Such a construction has a number of advantages. Since only a single connection flange is used between the pressure exchanger and the booster pump and not a stack of plates, pressure losses can be avoided which can occur at the edges of the plates of the stack. Furthermore, a single connection flange can be made more stable in thickness direction than a stack of plates having the same thickness which improves the leakage characteristic of the hydraulic arrangement. Lower leakages give a better efficiency.

Preferably said flange comprises a low pressure input of said pressure exchanger and a high pressure channel connecting a high pressure output of said pressure exchanger and a low pressure inlet of said booster pump. The single connection flange can be used for two purposes. To this end it is only necessary to provide the corresponding channels and openings in the connection flange.

Preferably said high pressure output of said pressure exchanger and said low pressure inlet of said booster pump are offset relative to each other in direction of rotation of said pressure exchanger. The pressure exchanger has a number of cylinders which are arranged in a rotating cylinder drum. Liquid within the cylinders already has a component of velocity which is directed in direction of rotation. This component of velocity can be used to feed the liquid coming from the pressure exchanger into the booster pump which, as a rule, has also rotating elements with which the pressure of the liquid is further increased. It is therefore possible to feed the incoming liquid into the booster pump with a directional component in circumferential direction of the booster pump thereby saving energy since the energy for accelerating the liquid in rotational direction can be reduced.

Preferably said high pressure channel is twisted along an axis of rotation of said pressure exchanger. This keeps low pressure losses within said high pressure channel. The twist of the high pressure channel allows that the liquid coming out of the pressure exchanger flows with a component of movement in rotational direction to the booster pump thereby keeping moving energy or kinetic energy.

In a preferred embodiment said booster pump has at its low pressure inlet an inlet area having a width in radial direction, said width increasing in direction of rotation. The inlet area can, for example, be formed by a sort of kidney-shaped opening or recess in a stationary port plate of the booster pump. When the width increases in direction of rotation the flow resistance within this area decreases in direction of rotation making it possible to reduce the flow resistance for the liquid within said inlet area without wasting too much energy. The liquid entering the booster pump therefore can have a considerable velocity component in direction of rotation when entering the displacement elements of the booster pump. When, for example, the booster pump is a vane cell pump, the liquid which is to be pressurized to a high pressure level has to be moved in circumferential or rotational direction. This is facilitated since the liquid already has a velocity component in this direction.

In a preferred embodiment said pressure exchanger has at its high pressure output an outlet area, said inlet area being longer in direction of rotation than said outlet area. The outlet area as well can be formed by a kidney-shaped opening in a stationary port plate of the pressure exchanger. When the inlet area is longer in direction of rotation than the outlet area, the flow resistance for the liquid moving from the pressure exchanger to the booster pump can be optimized.

Preferably said high pressure channel has a cross section, said cross section increasing in a direction from said pressure exchanger to said booster pump. In this way it is possible to decrease the differential flow resistance over the length of the high pressure channel so that the liquid flowing from the pressure exchanger in direction to the booster pump is not decelerated but can enter the booster pump with a velocity as high as possible.

Furthermore, it is preferred that said high pressure channel has a directional component in radial direction. In this way it is possible to use the centrifugal force acting on the liquid in the cylinders of the pressure exchanger when the cylinders rotate around an axis to pump the liquid from the pressure exchanger to the booster pump thereby keeping low the energy needed.

Furthermore, it is preferred that said low pressure input of said pressure exchanger has a directional component which is arranged tangentially with respect to a circle line around said axis of rotation. In this way it is possible to use the kinetic energy of the incoming liquid entering the pressure exchanger since this incoming liquid moves in the same direction as the cylinders of the pressure exchanger. Less energy is needed to accelerate this incoming liquid in direction of rotation when this liquid enters the cylinders.

Preferably said low pressure input has a cross section in a plane perpendicular to said axis of rotation, said cross section increasing in direction of rotation. It is therefore possible to decrease the flow resistance for the incoming liquid up to the moment when this liquid enters the cylinders.

Preferably said low pressure input has a trailing border in direction of rotation, said trailing border being angled to a radial direction of said pressure exchanger. The other border can, however, be parallel to a radial direction of said pressure exchanger. The trailing border of the low pressure input makes it possible to direct the incoming liquid tangentially to the axis of rotation of said pressure exchanger.

In a preferred embodiment said booster pump, said flange, and said pressure exchanger are arranged in a common casing. Such a casing forms a wall at least in circumferential direction around the parts mentioned. The casing serves to align the components mentioned above to each other. Furthermore, a number of connecting means for connecting these elements and securing them against sharing forces can be saved. Time and manpower for mounting the hydraulic arrangement can be kept low.

In a preferred embodiment said common casing is in form of a tube. Such a tube has the form of a hollow cylinder. A hollow cylinder has the advantage that it does not change form when the pressure in the interior of the tube increases.

In a preferred embodiment said casing comprises a step in its inner wall and said flange rests against said step. The step is a mounting aid. It is a simple means for exactly positioning the flange within the casing.

In a preferred embodiment said flange is connected to at least one port connection, said port connection running through said casing and fixing said flange in said casing. In particular in connection with a step such a fixation is sufficient to hold the flange reliably within the casing. In any case, the forces acting on the flange within the casing in one direction are usually not too high since the pressure difference over the flange can be kept small.

A preferred example of the invention will now be describe in more detail with reference to the drawing, wherein:

DETAILED DESCRIPTION

Figure 1:
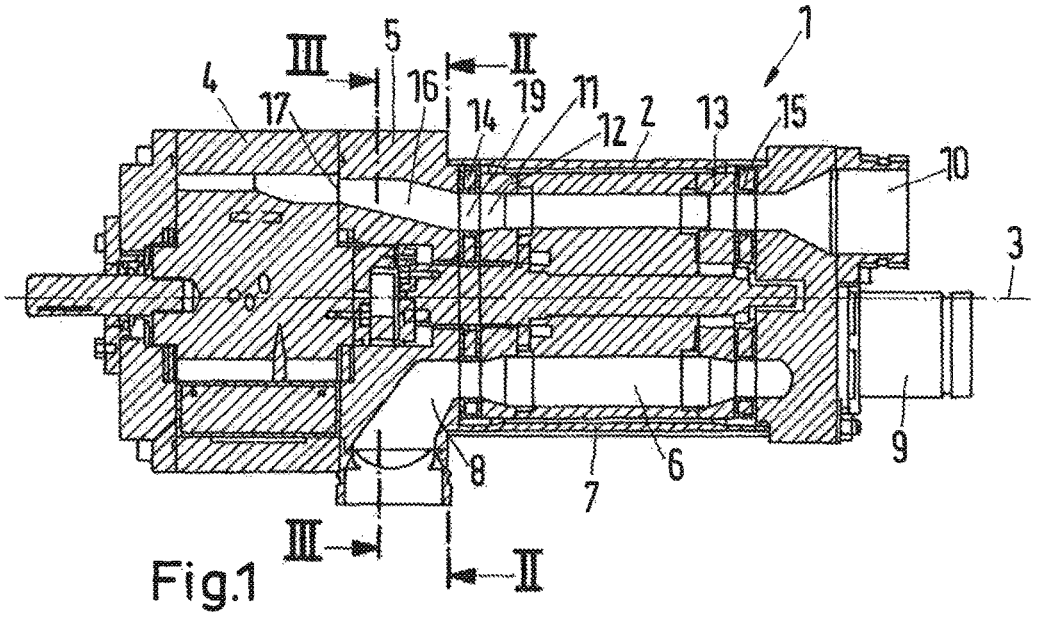
FIG. 1 shows a schematic longitudinal section of a hydraulic arrangement having a pressure exchanger and a booster pump.

All FIG. show the same elements with the same reference numerals.

A hydraulic arrangement 1 comprises a pressure exchanger 2 having an axis 3 of rotation. Furthermore, the hydraulic arrangement 1 comprises a booster pump 4 in form of a vane cell pump. However, other types of pump are basically possible.

The pressure exchanger 2 and the booster pump 4 are connected to each other by means of a single flange 5.

The pressure exchanger 2 comprises a number of cylinders 6 which are arranged in a cylinder drum 7. The cylinder drum 7 is rotatable about the above mentioned axis 3.

The pressure exchanger 2 comprises a low pressure input 8, a low pressure output 9, a high pressure input 10 and a high pressure output 11.

Such a hydraulic arrangement 1 can be used in a reverse osmosis system, for example, to desalt sea water. In the operation of such a reverse osmosis system seawater, i.e. salted water, is pressed with a rather high pressure level through a membrane to gain purified water. The rest of the water, so called "concentrate" has still a relatively high pressure, but has to be wasted. In order to recover the pressure energy, the concentrate is supplied to the high pressure input 10 of the pressure exchanger 2. The low pressure input 8 is supplied with seawater which pushes out the remaining concentrate through the low pressure output 9. When the cylinder drum 7 rotates, the fresh sea water is pressurized by the pressure of the concentrate at the high pressure input 10 and pushed out with elevated pressure through the high pressure output 11, as it is known.

In most cases it is necessary to increase the pressure level of the fresh sea water further to pump it through the membrane. To this end the booster pump 4 is used.

The single flange 5 between the pressure exchanger 2 and the booster pump 4 has a number of advantages. In contrast to a flange formed by a stack of plates there is less flow resistance because there are no transitions between neighboring plates of the stack. Furthermore, the single flange 5 can be made relatively stable so that it can withstand higher pressures without being deformed.

The pressure exchanger 2 has a first valve plate 12 at one axial end and a second valve plate 13 at the second axial end. The first valve plate 12 rests against a first port plate 14. The second valve plate 13 rests against a second port plate 15. The first port plate 14 is supported by the mechanically stable flange 5.

The low pressure input 8 of the pressure exchanger 2 is provided within the flange 5. The flange 5 furthermore comprises a high pressure channel 16 connecting the high pressure output 11 of the pressure exchanger to a low pressure inlet 17 of the booster pump 4. This low pressure inlet 17 is formed in an inlet area 18 (FIG. 2) which is offset relative to the high pressure output 11 of the pressure exchanger 2. This offset is symbolized in FIG. 2 by an angle $\alpha$.

The high pressure output 11 of the pressure exchanger 2 is formed in an outlet area 19, for example, a kidney-opening in the first port plate 14. The inlet area 18, which basically is a kidney-shaped recess as well, and the outlet area 19 overlap each other. However, the inlet area 18 is longer in direction of rotation than the outlet area 19. The offset $\alpha$ is defined between the centers of the inlet area 18 and the outlet area 19 in circumferential direction.

To achieve a connection between the outlet area 19 and the inlet area 18, the high pressure channel 16 is twisted along the axis 3 of rotation of the pressure exchanger 2. Furthermore, as can be seen in FIG. 1, the high pressure channel 16 has a directional component in radial direction, i.e. it runs at least partially with an angle relative to the axis 3 of rotation.

Figure 2:
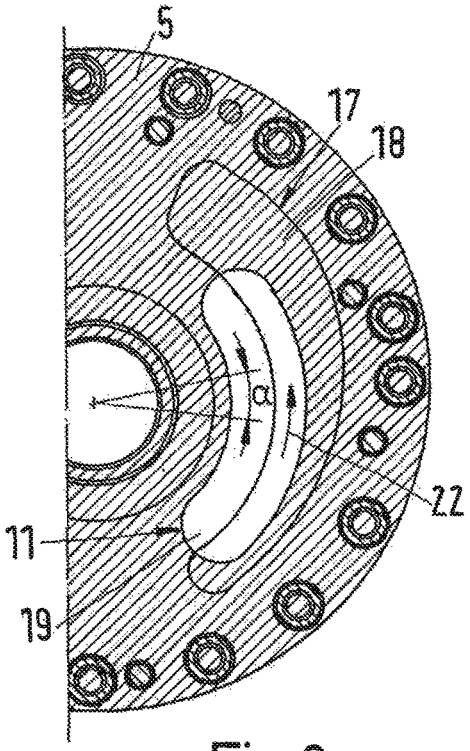
FIG. 2 shows a schematic sectional view of a flange at a high pressure side of the pressure exchanger according to a section II-II of FIG. 1.

As can be seen in FIG. 2, the outlet area 19 has a smaller size than the inlet area 18. To achieve a smooth transition, the high pressure channel 16 has a cross section increasing in a direction from said pressure exchanger 2 to said booster pump 4 thereby decreasing the differential throttling resistance over the length.

Figure 3:
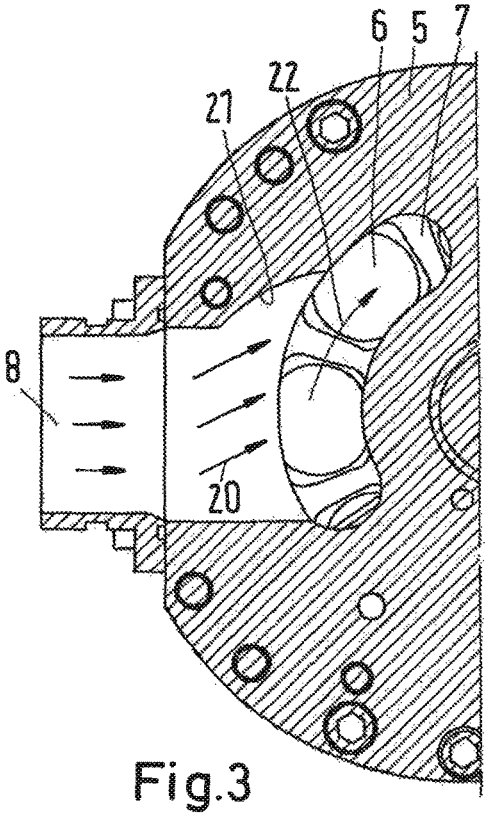
FIG. 3 shows a schematic section III-III of FIG. 1 at a low pressure side of the pressure exchanger.

FIG. 3 shows schematically the situation in the region of the low pressure input 8 of the pressure exchanger 2. Incoming fluid symbolized by arrows 20 passes through the low pressure input 8. In the plane shown in FIG. 3, the low pressure input 8 has a section increasing in flow direction. The low pressure input 8 has a trailing border 21 which is angled to a radial direction of the pressure exchanger. Therefore, as can be seen in FIG. 3, the incoming fluid is directed in direction 22 of rotation of the cylinder drum 7. Therefore, less energy is necessary to accelerate this incoming liquid when this liquid enters the cylinders 6 of the pressure exchanger 2.

Although the embodiment describes is preferred, it is also possible to use the construction of the low pressure input as shown in FIG. 3 done, i.e. without the optimized high pressure channel 17. It is furthermore possible to use the optimized high pressure channel 17 alone without the construction of the low pressure input 8 shown in FIG. 3.

Figure 4:
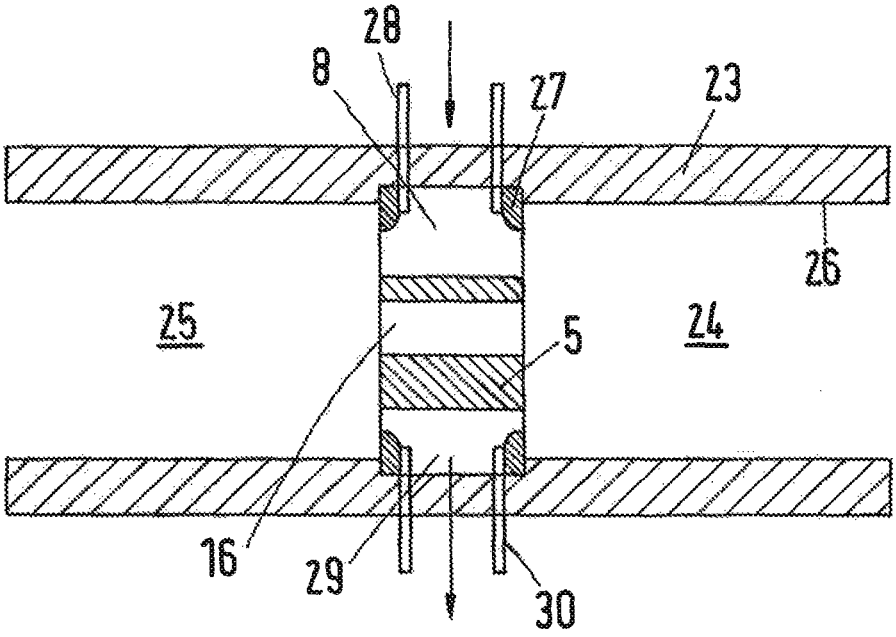
FIG. 4 shows a casing for the hydraulic arrangement.

FIG. 4 shows schematically a casing 23 adapted for receiving the pressure exchanger 2 in a section 24 of the casing and of the booster pump 4 in a section 25 of the casing. Pressure exchanger 2 and booster pump 4 are not shown for the sake of clarity.

Casing 23 is of tubular form, i.e. casing 23 forms a hollow cylinder. Casing 23 comprises an inner wall 26 running in circumferential direction. Said inner wall 26 comprises a step 27 against which flange 5 rests. Step 27 defines the axial position of flange 5 within casing 23.

Low pressure input 8 is connected to a port connection 28. Port connection 28 is guided through casing 23 and fixes flange 5 relative to casing 23. Furthermore, an outlet 29 is shown connected to a further port connection 30, said port connection 30 serving as fixation of the flange 5 as well.

When the hydraulic arrangement with pressure exchanger 2, booster pump 4 and flange 5 is assembled, casing 23 surrounds these three elements in circumferential direction so that only very few additional connecting elements are necessary to hold together these three elements.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A hydraulic arrangement comprising a pressure exchanger having an axis of rotation, and a booster pump, said pressure exchanger and said booster pump being connected to each other, wherein a single connection flange is provided between said pressure exchanger and said booster pump, wherein said flange comprises a low pressure input of said pressure exchanger and a high pressure channel connecting a high pressure output of said pressure exchanger and a low pressure inlet of said booster pump, wherein said high pressure output of said pressure exchanger and said low pressure inlet of said booster pump are offset relative to each other in a direction of rotation of said pressure exchanger, the direction of rotation being in a circumferential direction of said pressure exchanger, and wherein said booster pump has at its low pressure inlet an inlet area having a width in a radial direction, said width increasing in the direction of rotation.

2. The hydraulic arrangement according to claim 1, wherein said high pressure channel is twisted along an axis of rotation of said pressure exchanger.

3. The hydraulic arrangement according to claim 2, wherein said booster pump has at its low pressure inlet an inlet area having a width in radial direction, said width increasing in the direction of rotation.

4. The hydraulic arrangement according to claim 2, wherein said high pressure channel has a cross section, said cross section increasing in a direction from said pressure exchanger to said booster pump.

5. The hydraulic arrangement according to claim 2, wherein said high pressure channel has a directional component in a radial direction.

6. The hydraulic arrangement according to claim 1, wherein said pressure exchanger has at its high pressure output an outlet area, said inlet area being longer in the direction of rotation than said outlet area.

7. The hydraulic arrangement according to claim 6, wherein said high pressure channel has a cross section, said cross section increasing in a direction from said pressure exchanger to said booster pump.

8. The hydraulic arrangement according to claim 1, wherein said high pressure channel has a cross section, said cross section increasing in a direction from said pressure exchanger to said booster pump.

9. The hydraulic arrangement according to claim 1, wherein said high pressure channel has a directional component in a radial direction.

10. The hydraulic arrangement according to claim 1, wherein said low pressure input of said pressure exchanger has a directional component which is arranged tangentially with respect to a circle line around said axis of rotation.

11. The hydraulic arrangement according to claim 10, wherein said low pressure input has a cross section in a plane perpendicular to said axis of rotation, said cross section increasing in direction of flow.

12. The hydraulic arrangement according to claim 11, wherein said low pressure input has a trailing border in direction of rotation, said trailing border being angled to a radial direction of said pressure exchanger.

13. The hydraulic arrangement according to claim 1, wherein said booster pump, said flange, and said pressure exchanger are arranged in a common casing.

14. The hydraulic arrangement according to claim 13, wherein said common casing is in form of a tube.

15. The hydraulic arrangement according to claim 13, wherein said casing comprises a step in its inner wall and said flange rests against said step.

16. The hydraulic arrangement according to claim 13, wherein said flange is connected to at least one port connection, said port connection running through said casing and fixing said flange in said casing.

17. A hydraulic arrangement comprising a pressure exchanger having an axis of rotation, and a booster pump, said pressure exchanger and said booster pump being connected to each other, wherein a single connection flange is provided between said pressure exchanger and said booster pump, wherein said flange comprises a low pressure input of said pressure exchanger and a high pressure channel connecting a high pressure output of said pressure exchanger and a low pressure inlet of said booster pump, wherein said low pressure input of said pressure exchanger has a directional component which is arranged tangentially with respect to a circle line around said axis of rotation, and wherein said low pressure input has a cross section in a plane perpendicular to said axis of rotation, said cross section increasing in direction of flow.

18. The hydraulic arrangement according to claim 17, wherein said low pressure input has a trailing border in direction of rotation, said trailing border being angled to a radial direction of said pressure exchanger.

* * * * *